US007322318B2

(12) United States Patent
Nagahashi et al.

(10) Patent No.: US 7,322,318 B2
(45) Date of Patent: Jan. 29, 2008

(54) COOLING SYSTEM FOR AN INTERNAL COMBUSTION ENGINE, AND ENGINE INCORPORATING SAME

(75) Inventors: Yoshiki Nagahashi, Saitama (JP); Naoki Kono, Saitama (JP); Masaki Yoneyama, Saitama (JP); Kohji Minami, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/711,269

(22) Filed: Feb. 27, 2007

(65) Prior Publication Data

US 2007/0199524 A1 Aug. 30, 2007

(30) Foreign Application Priority Data

Feb. 28, 2006 (JP) ..... 2006-052761

(51) Int. Cl.
*F01P 1/04* (2006.01)

(52) U.S. Cl. ..... 123/41.35; 123/196 R

(58) Field of Classification Search ..... 123/41.35, 123/195 R, 196 R
See application file for complete search history.

(56) References Cited

U.S. PATENT DOCUMENTS 5,860,404 A 1/1999 Tanaka
2001/0042526 A1* 11/2001 Moller et al. ..... 123/41.35
2003/0041815 A1 3/2003 Kawakubo et al.
2006/0169224 A1 8/2006 Lenz et al.

FOREIGN PATENT DOCUMENTS

| | | |
|---|---|---|
| DE | 4012475 | 10/1990 |
| DE | 19803242 | 8/1998 |
| EP | 1288460 | 3/2003 |
| EP | 1676989 | 7/2006 |
| GB | 187425 | 10/1922 |
| JP | 2003-074347 | 3/2003 |

* cited by examiner

*Primary Examiner*—Noah P. Kamen
(74) *Attorney, Agent, or Firm*—Carrier, Blackman & Associates, P.C.; William D. Blackman; Joseph P. Carrier

(57) ABSTRACT

An internal combustion engine is provided with an internal piston cooling system that jets oil from an oil jet onto a surface of a piston during engine operation, to effectively cool the piston. In the piston cooling system of the internal combustion engine, each piston being arranged to reciprocate in a cylinder bore of a cylinder block, and oil is jetted from individual oil jets to each piston, respectively. An oil reservoir is formed in a crankcase journal wall, that journals a crankshaft of the engine. In the crankcase, oil supply passages are provided for supplying oil from a hydraulic supply source to the oil reservoir, and in turn, oil is operatively supplied from the oil reservoir to the oil jets via a passageway.

14 Claims, 9 Drawing Sheets

COOLING SYSTEM FOR AN INTERNAL COMBUSTION ENGINE, AND ENGINE INCORPORATING SAME

CROSS-REFERENCE TO RELATED APPLICATIONS

The present invention claims priority under 35 USC 119 based on Japanese patent application No. 2006-052761, filed on Feb. 28, 2006. The entirety of the subject matter of this priority document is incorporated by reference herein.

BACKGROUND OF THE INVENTION

1. Field of the Invention

The present invention relates generally to internal combustion engines. More particularly, the present invention relates to a piston cooling system in an internal combustion engine, in which oil is jetted to a piston to provide a cooling effect, where the piston is adapted to reciprocate in a cylinder bore.

2. Description of the Background Art

In a conventional piston cooling system of an internal combustion engine, an oil jet is normally provided on a journal wall that journals a crankshaft. Oil discharged from an oil pump is directed to the oil jet, and the cooling oil is directly jetted from the oil jet to a piston which is reciprocating in a cylinder bore. By doing so, the piston is cooled. Such a conventional piston cooling system is disclosed, for example, in JP-A No. 2003-74347.

The piston cooling system disclosed in JP-A No. 2003-74347 is applied to a multi-cylinder internal combustion engine, and oil discharged from an oil pump provided to a crankcase is directed to a main gallery formed in the crankcase via an oil filter and an oil cooler. The oil is distributed from the main gallery to a branch oil supply passage formed in each journal wall, is supplied to each journal bearing, and a portion of the oil is jetted to a piston from an oil jet provided in a journal wall.

Since the oil pump is driven using the rotation of a crankshaft as a power source, it is difficult to supply oil in a stable manner to the oil jet because the rotating torque of the oil pump periodically varies and the discharge pressure of oil pulses. Moreover, it is difficult to minimize the quantity of oil supplied to cool the piston and to effectively and efficiently jet oil from the oil jet.

The invention is made in view of the above described problems, and the object of the invention is to provide a piston cooling system of an internal combustion engine where oil is effectively jetted from an oil jet, and a piston can be efficiently cooled.

SUMMARY

To achieve the above described object, a first aspect of the invention is based upon a piston cooling system of an internal combustion engine where oil is jetted from an oil jet to a piston adapted to reciprocate in a cylinder bore of a cylinder block. The first aspect of the invention is characterized in that an oil reservoir is formed within a journal wall. The journal wall journals a crankshaft in a crankcase in which oil supply passages for supplying oil to the oil jets from a hydraulic supply source are laid.

According to the first aspect of the invention, in the piston cooling system of the internal combustion engine, the oil reservoir is formed in the journal wall that journals the crankshaft in the crankcase in which the oil supply passages for supplying oil to the oil jets from the hydraulic supply source are laid. As a result, oil jetted from the oil jet is previously reserved in the oil reservoir on the upstream side of the oil jet. Therefore, the pulsation of the oil discharge pressure of the oil pump is attenuated, oil is supplied to the oil jet in a stable manner, oil is effectively jetted from the oil jet, and the piston can be efficiently cooled.

A second aspect of the invention is based upon the piston cooling system of the internal combustion engine of the first aspect thereof, and is further characterized in that the crankcase is partitioned into an upper crankcase portion and a lower crankcase portion, the upper and lower crankcase portions being joined at respective joined faces. The oil reservoir is formed in the upper crankcase portion so that the oil reservoir is open to the joined face of the upper crankcase portion. The oil reservoir is further formed by closing a part of an opening for the oil reservoir with the joined face of the lower crankcase portion.

According to the second aspect of the invention, in the piston cooling system of the internal combustion engine, since the crankcase is partitioned into two crankcase portions, and the oil reservoir is formed in the upper crankcase portion so that the oil reservoir is open to a joined face of the crankcase, the oil reservoir is formed during casting of the crankcase and thus no mechanical working of the crankcase is required.

In addition, since the oil reservoir is formed by closing a part of an opening of the oil reservoir with joined face of the lower crankcase, no dedicated cover member is separately required to create the oil reservoir, whereby the number of parts is reduced.

A third aspect of the invention is based upon the piston cooling system of the internal combustion engine disclosed in either the first or second aspects thereof, and is further characterized in that the internal combustion engine is a parallel multi-cylinder internal combustion engine in which plural cylinders are arranged in parallel. The oil jet is formed on a tube-like member arranged on an axis parallel to the crankshaft, and an oil inlet of the tube-like member is open to the oil reservoir.

According to the third aspect of the invention, in the piston cooling system of the internal combustion engine, since the oil jet is formed on the tube-like member arranged on the axis parallel to the crankshaft and the oil inlet of the tube-like member is open to the oil reservoir, plural oil jets are concentrated on the tube-like member, as compared with a conventional configuration in which each oil jet is attached to each journal wall of a crankcase, and therefore, the piston cooling system is excellent with respect to ease of assembly.

A fourth aspect of the invention is based upon the piston cooling system of the internal combustion engine of the first aspect thereof, and is further characterized in that the cylinder block is joined to the crankcase along a second joined face, and a tapped hole extends through the crankcase from the second joined face to the oil reservoir, and a part of the distal end of a fastening member screwed into the tapped hole protrudes into the oil reservoir.

According to the fourth aspect of the invention, in the piston cooling system of the internal combustion engine, the tapped hole extends from the second joined face, at which the crankcase is joined to the cylinder block, to the oil reservoir, and a part of the distal end of the fastening member screwed into the tapped hole protrudes in the oil reservoir. As a result, the fastening member is screwed into the overall tapped hole that extends from the joined face of the crankcase to the oil reservoir, and the concentration in a part of stress that acts on the vicinity of the tapped hole by screwing and tightening the fastening member is reduced.

Since the stress concentration reducing structure is formed utilizing the oil reservoir for stably supplying oil to the oil jet, no separate dedicated structure is required, and the corresponding work for providing the dedicated structure is also not required.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

DETAILED DESCRIPTION

Figure 1:
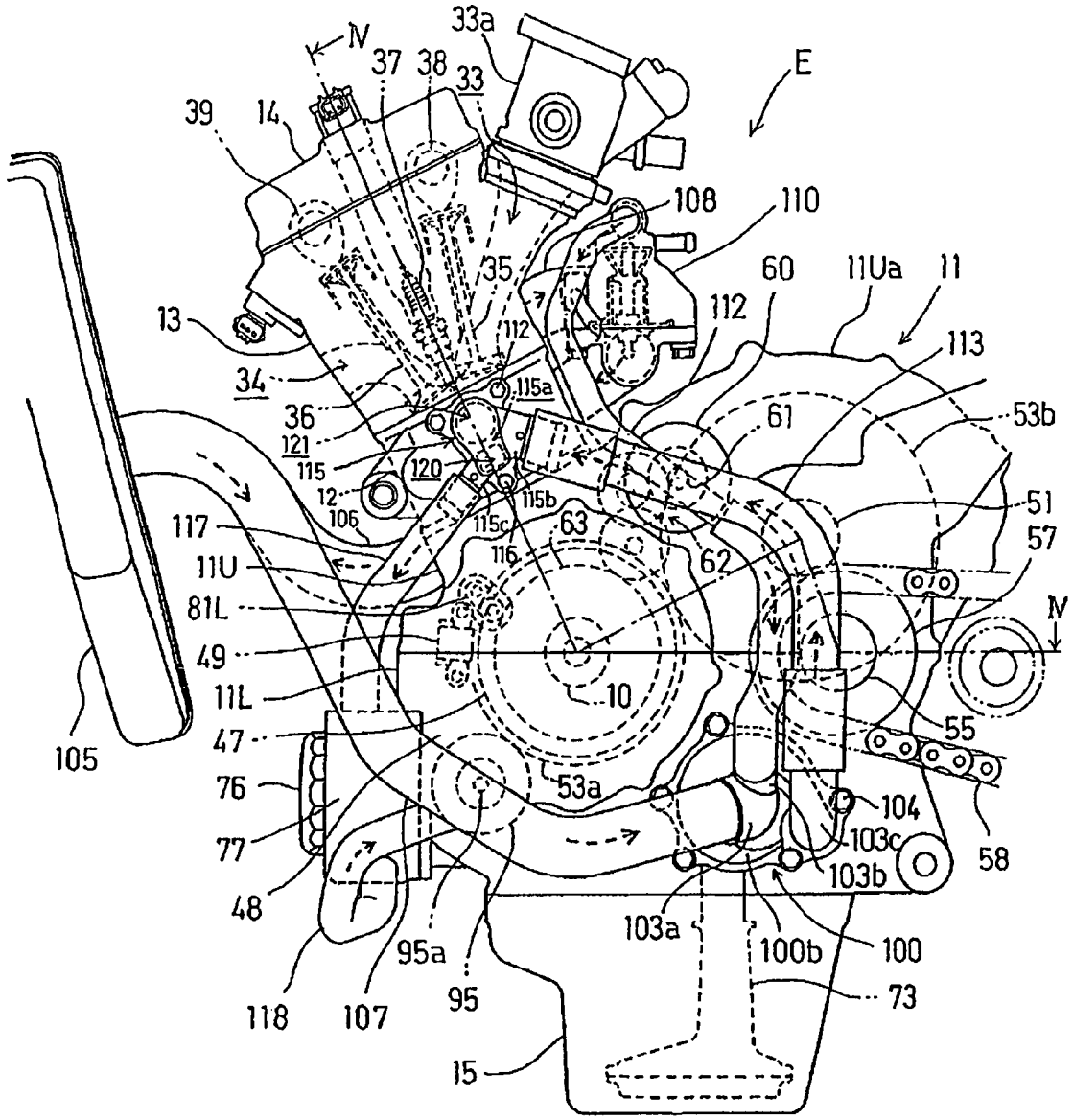
FIG. 1 is a left side plan view of an internal combustion engine incorporating a piston cooling structure according to one embodiment of the invention, showing a hose arrangement corresponding to the engine cooling system, and showing selected internal engine parts in phantom.

A selected illustrative embodiment of the invention will now be described in some detail, with reference to FIGS. 1 to 10. It should be understood that only structures considered necessary for clarifying the present invention are described herein. Other conventional structures, and those of ancillary and auxiliary components of the system, are assumed to be known and understood by those skilled in the art.

The embodiment of the cooling structure for the vehicular generator is described in association with an internal combustion engine E. The engine E is, for example, a four-cylinder in-line water-cooled internal combustion engine where four cylinders are arranged in series, and this engine may be transversely mounted in a motorcycle with a crankshaft 10 directed sideways.

In this specification, a reference to "forward" refers to a forward direction of the vehicle, a reference to "backward" refers the rearward direction of the vehicle, and references to "right" and "left" are made the vantage point of a driver seated on the motorcycle and facing in a forward direction of the vehicle.

In the engine E, a crankcase 11 that journals the crankshaft 10 is vertically divided, and four cylinders 12*c* are arrayed in series on an upper crankcase 11U. A cylinder head 13 overlies, and is integrated with, a cylinder block 12, and each of the cylinder block 12 and the cylinder head 13 is slightly inclined in the forward direction. In addition, the cylinder head 13 is covered with a cylinder head cover 14, and an oil pan 15 is attached under a lower crankcase 11L.

Figure 4:
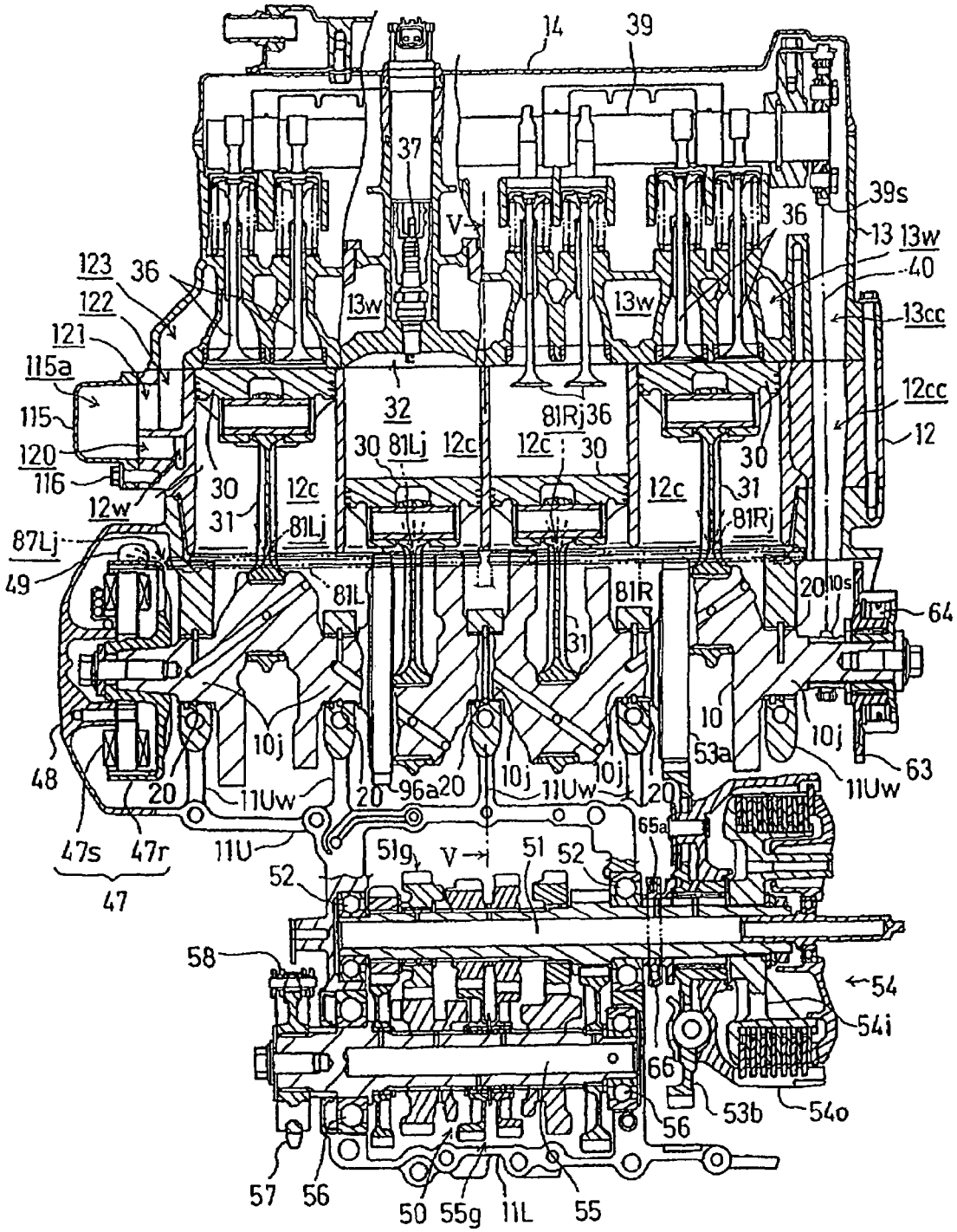
FIG. 4 is a front sectional view of the internal combustion engine of FIGS. 1-3, viewed along a line IV-IV in FIG. 1.
Figure 5:
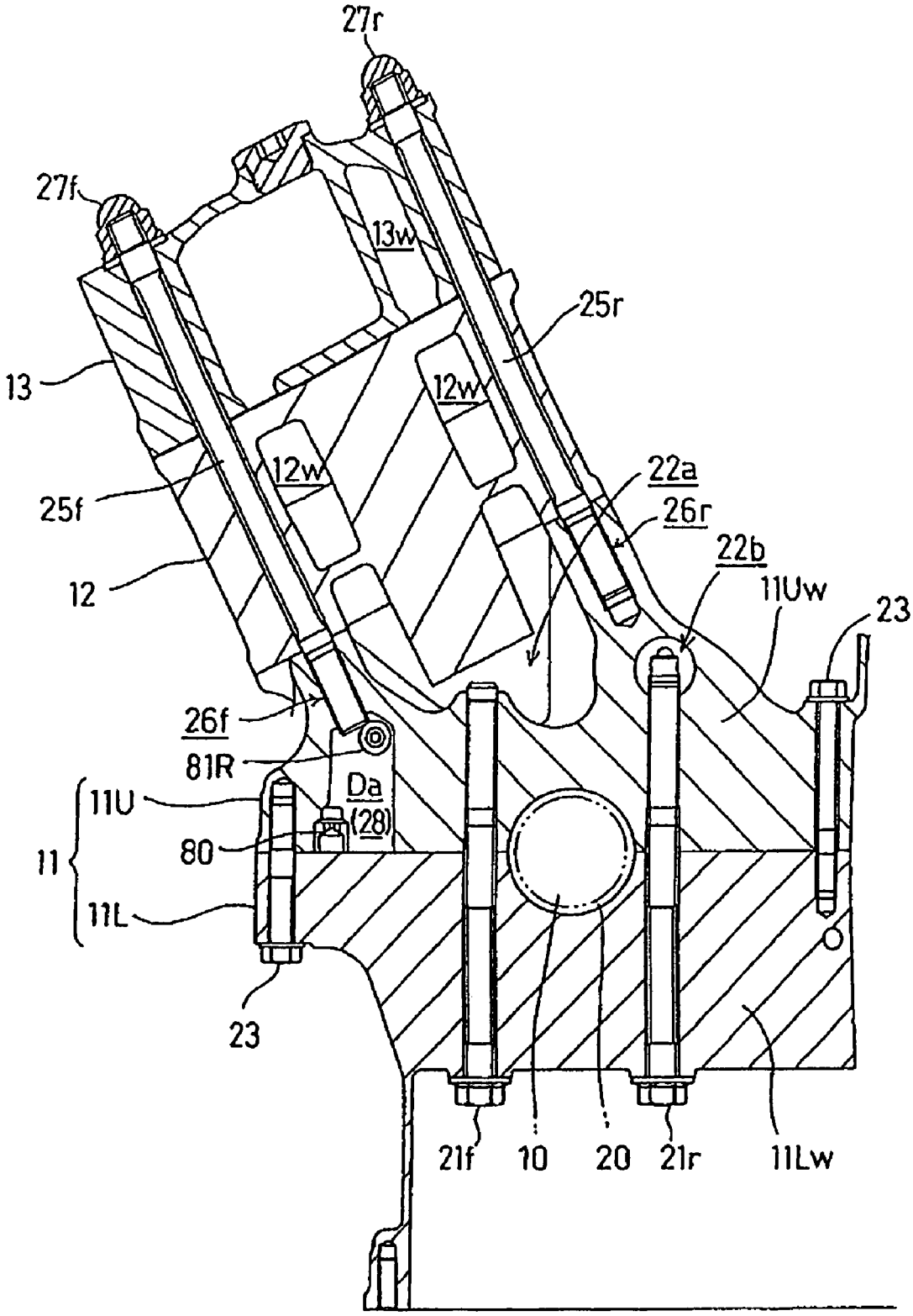
FIG. 5 is a schematic left side detail sectional view showing a portion of the crankcase of the internal combustion engine of FIGS. 1-4 as viewed along a line V-V in FIG. 4.

Referring to FIGS. 4 and 5, each journal wall 11Uw, 11Lw of the upper crankcase 11U and the lower crankcase 11L supports a journal 10*j* of the crankshaft 10 via a main bearing 20 with the journal vertically held between the journal walls and journals the crankshaft 10 so that the crankshaft 10 can be rotatably journaled. Because the internal combustion engine according to the invention is an in-line 4-cylinder internal combustion engine E, the crankshaft 10 is provided with five journals 10*j* and is rotatably supported by upper and lower each five journal walls 11Uw, 11Lw of the upper crankcase 11U and the lower crankcase 11L. The upper crankcase 11U and the lower crankcase 11L are integrally fastened by bolts by joining their respective faces.

Referring to FIG. 5, in each of each five journal walls 11Uw, 11Lw of the upper crankcase 11U and the lower crankcase 11L, stud bolts 21*f*, 21*r* pierce the lower crankcase 11L straight upward from the lower side thereof, are screwed into long tapped holes of the upper crankcase 11U, and are tightened. Each of the upper crankcase 11U and the lower crankcase 11L are provided with confronting semicircular parts sized and shaped to hold the crankshaft 10 therein, the semicircular parts formed between the stud bolts.

The distal end of the stud bolt 21*f* provided on the front side of the semicircular part protrudes into a cavity 22*a* of the crankcase after the stud bolt is screwed into the tapped hole of the upper crankcase 11U.

The distal end of the stud bolt 21*r* provided on the rear side of the semicircular part protrudes into a circular hole 22*b* bored in parallel with the crankshaft 10 in the upper crankcase 11U after the stud bolt is screwed into the tapped hole of the upper crankcase 11U. Therefore, the concentration in a part of stress, which is caused by screwing and tightening the stud bolts 21*f*, 21*r*, and which acts on the vicinity of the tapped holes, is reduced.

The upper crankcase 11U and the lower crankcase 11L are fastened not only by the stud bolts 21*f*, 21*r*, but are also fastened by plural bolts 23 in required locations (see FIG. 5).

The cylinder block 12 is superimposed on the upper crankcase 11U by mutually joining faces thereof in a state in which the cylinder block is a little tilted forward. The cylinder head 13 is superimposed on the cylinder block 12, and front and rear stud bolts 25*f*, 25*r* pierce, from above, the cylinder head 13, the cylinder block 12, and a portion of the journal wall 11Uw of the upper crankcase 11U which adjoins the cylinder block 12. The stud bolts 25*f*, 25*r* are screwed into tapped holes 26*f*, 26*r* bored in the upper crankcase 11U, whereby the cylinder block and the cylinder head are integrally fastened.

Specifically, lower ends of the stud bolts 25*f*, 25*r* are screwed into the tapped holes 26*f*, 26*r* bored on the joined face of the upper crankcase 11U. In addition, the stud bolts 25*f*, 25*r* protrude upward in an embedded state, through holes of the cylinder block 12 which are fitted to the stud bolts 25*f*, 25*r*, so that the cylinder block 12 is superimposed on the upper face of the upper crankcase 11U. The through holes formed in the cylinder head 13 are fitted to the stud bolts 25*f*, 25*r*, and are aligned with the through holes of the cylinder block 12. Via the stud bolts 25*f*, 25*r* extending through the through holes and protruding from them, the cylinder head 13 is superimposed on an upper joined face of the cylinder block 12. The stud bolts 25*f*, 25*r* are further screwed into the tapped holes 26*f*, 26*r* together with cap nuts 27*f*, 27*r* by screwing cap nuts 27*f*, 27*r* on male screws formed at the upper (proximal) ends of the stud bolts 25*f*, 25*r* that protrude from the through holes of the cylinder head 13. By tightening nuts 27*f*, 27*r*, the cylinder block 12 and the cylinder head 13 are integrally fastened to the upper crankcase 11U.

A cavity 28 is formed in the three journal walls 11Uw in the center of the upper crankcase 11U so that the cavity is open to the joined face of the of the upper 11U and lower 11L portions of the crank case 11, and so that the front tapped hole 26*f* extends through the joined face of the upper crankcase 11U and the cylinder block 12, into the cylinder block 12, and reaches the cavity 28.

The stud bolt 25*f* that pierces the cylinder head 13 and the cylinder block 12 is screwed into the tapped hole 26*f* and the distal end is open to the cavity 28. Therefore, the concentration in a part of stress which is caused by screwing and tightening the stud bolt 25*f* and which acts on the vicinity of the tapped hole in the upper crankcase 11U is reduced.

As described above, a piston 30 is fitted into each cylinder bore 12*c* of four cylinders of the cylinder block 12 integrally fastened to the upper crankcase 11U so that the piston 30 can be reciprocated. Each piston is coupled to the crankshaft 10 via a connecting rod 31.

In the cylinder head 13, for every cylinder bore 12*c*, a combustion chamber 32 is formed opposite to the piston 30. An intake port 33, which is open to the combustion chamber 32 and which is opened and closed by a pair of intake valves 35, extends rearward. An exhaust port 34, which is opened and closed by a pair of exhaust valves 36, extends forward. In addition, an ignition plug 37 is installed opposite to the combustion chamber 32. A throttle body 33*a* is coupled to an opening on the upstream side of the intake port 33, an intake pipe not shown is coupled on the upstream side of the throttle body, and an exhaust pipe is coupled to an opening on the downstream side of the exhaust port 34.

Each intake valve 35 and each exhaust valve 36 are opened and closed in synchronization with the rotation of the crankshaft 10 by means of an intake camshaft 38 and an exhaust camshaft 39 which are rotatably journaled by the cylinder head 13. Additionally, cam sprockets 38*s*, 39*s* are fitted to right ends of the camshaft 38, 39, a timing chain 40 is put between a drive sprocket 10*s* fitted in the vicinity of the right end of the crankshaft 10 and each cam sprocket 38*s*, 39*s* (see FIGS. 2 and 4), and the timing chain is driven at revolution speed equivalent to a half of the revolution speed of the crankshaft 10.

Figure 2:
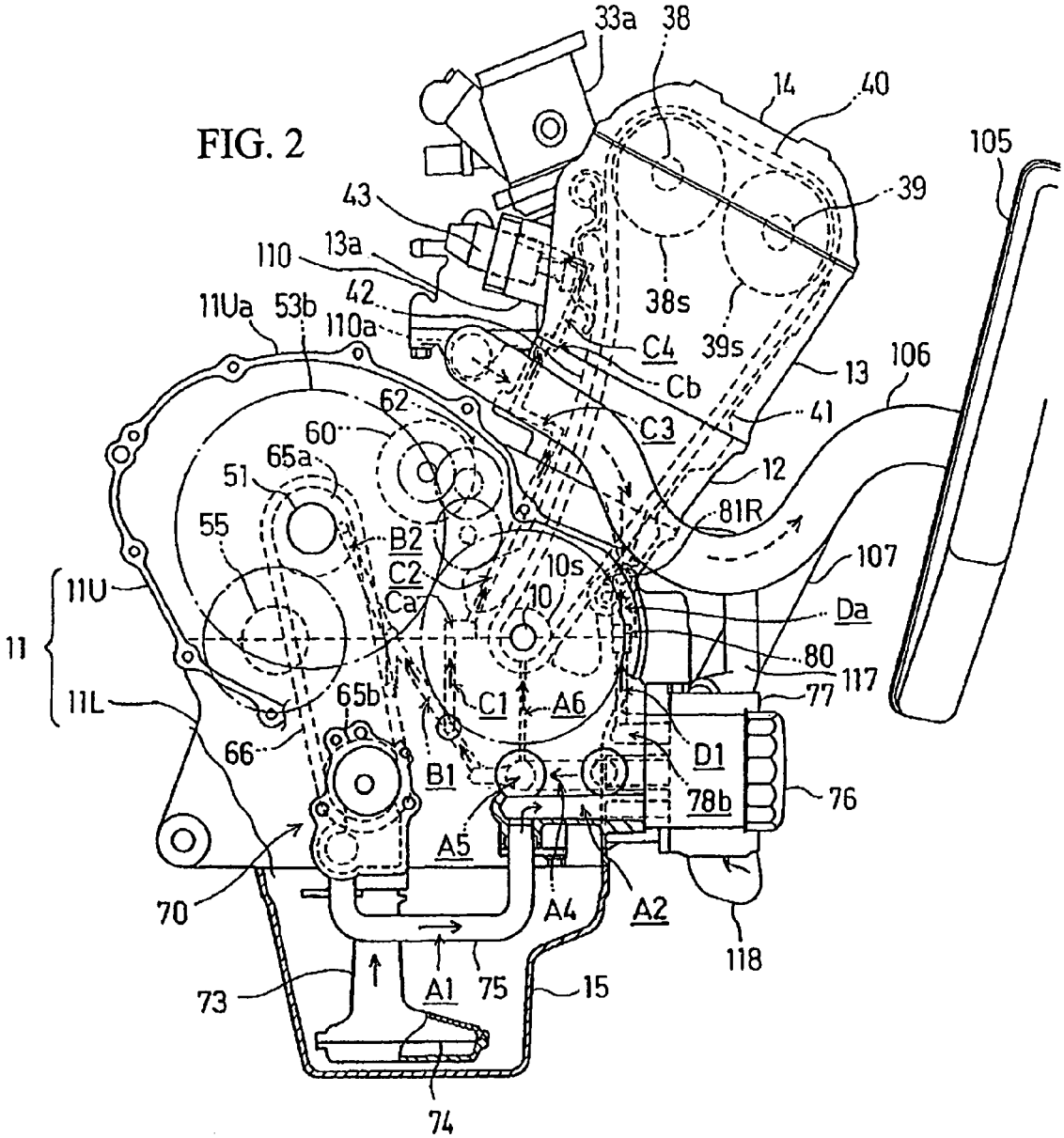
FIG. 2 is a right side sectional view of the internal combustion engine of FIG. 1, showing internal cooling oil passageways associated with a generator cooling structure.

Cam chain chambers 12*cc*, 13*cc* for housing the timing chain 40 are formed at the right ends of the cylinder block 12 and the cylinder head 13 (see FIG. 4). Cam chain guides 41, 42 are provided in the cam chain chambers 12*cc*, 13*cc* along the front and rear sides of the timing chain 40, and the rear cam chain guide 42 is pressed against the timing chain 40 by a hydraulic type cam chain tensioner 43, so as to apply a suitable tension thereto (see FIG. 2). The cam chain tensioner 43 is attached to a tensioner fixing boss 13*a* which protrudes rearward from a rear face of the right end of the cylinder head 13 as shown in FIG. 2.

In the meantime, referring to FIG. 4, the left end of the crankshaft 10 protrudes leftward from the leftmost journal walls 11Uw, 11Lw, which forms the left side wall of the crankcase 11. An outer rotor 47*r* of an AC generator 47 is fitted to the left end of the crankshaft 10. An inner stator 47*s* is provided with a magneto coil of the AC generator 47, is supported by a generator cover 48 which covers the AC generator 47 from the left side, and is arranged in the outer rotor 47*r*.

A pulser coil 49, which is an engine speed detector for detecting the number of revolutions of the crankshaft 10, is arranged near to the front of the outer periphery of the outer rotor 47*r* of the AC generator 47 in the generator cover 48.

A transmission 50 is arranged at the rear of the crankshaft 10 in the crankcase 11. The transmission 50 is a constant-mesh type gear transmission, and includes a main shaft 51 journaled to the upper crankcase 11U via a bearing 52 so that the main shaft can be rotated on the diagonal upside at the rear of the crankshaft 10, and a counter shaft 55 journaled via a bearing 56 so that the counter shaft can be rotated with the counter shaft held between the joined faces of the upper crankcase 11U and the lower crankcase 11L at the rear of the crankshaft 10. Opposite gears forming a pair in speed change gear groups 51*g*, 55*g* are mounted on the main shaft 51 and the counter shaft 55, which are respectively parallel to the crankshaft 10, and opposite gears forming a pair are engaged. Each gear is fitted to the shaft via a spline, and speed is changed by the shift of gears by a shift mechanism functioning as a shifter.

A multiple disc friction clutch 54 is provided at the right end of the main shaft 51. A primary driven gear 53*b* is supported by a clutch outer 54*o* of the friction clutch 54 so that the primary driven gear is rotated together with the clutch outer, and a primary drive gear 53, formed in a crank web on the rightmost side of the crankshaft 10 is engaged with the primary driven gear 53*b*. A primary deceleration mechanism is thus configured.

A clutch inner 54*i* on the output side of the friction clutch 54 is fitted to the main shaft 51 via a spline connection, and therefore the rotation of the crankshaft 10 is transmitted to the main shaft 51 via the primary deceleration mechanisms 53*a*, 53*b* and the friction clutch 54. The rotation of the main shaft 51 is transmitted to the counter shaft 55 via the engagement of the speed change gear groups 51*g*, 55*g*.

The counter shaft 55 also function as an output shaft, and the left end of the counter shaft 55 extends through the crankcase and protrudes outside thereof. An output sprocket 57 is fitted at the left end of the countershaft, and a transmission chain 58 joins the output sprocket 57 and a driven sprocket of a rear wheel not shown, whereby a secondary deceleration mechanism is configured. Motive power is transmitted to the rear wheel via the secondary deceleration mechanism.

As shown in FIG. 4, a driven gear for starting 63 is journaled via a one-way clutch 64 on the right side of the drive sprocket 10*s* on the crankshaft 10.

Figure 3:
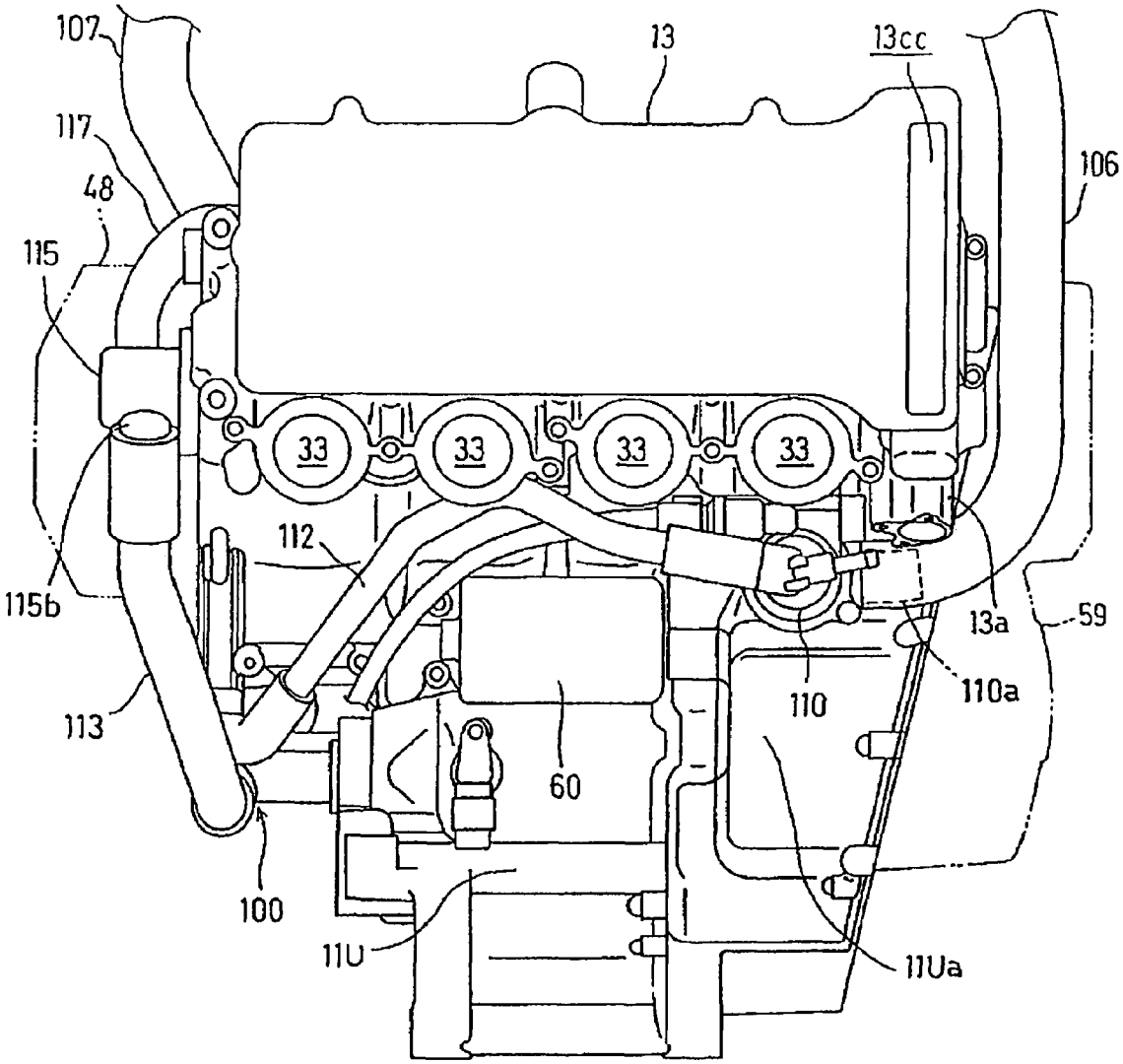
FIG. 3 is a top plan view of the internal combustion engine of FIGS. 1-2.

A starter motor 60 that starts the internal combustion engine E is attached to an upper face of the center of the crankcase 11 as shown in FIG. 3.

A right part of an upper wall of the upper crankcase 11U, at a location at the back of a part to which the cylinder block 12 is connected, greatly overhangs the friction clutch 54 and the primary driven gear 53*b*, thus protecting them from above. In addition, the starter motor 60 is attached along the left side of the overhanging part 11Ua. Moreover, the right side of the friction clutch 54 is covered with a clutch cover 59 (see FIG. 3).

A driving gear shaft 61, which protrudes on the right side of the starter motor 60, extends through a side wall of the overhanging part 11Ua of the upper crankcase 11U to its inside, and a speed reducing gear mechanism 62 is inserted between the driving gear shaft 61 and the driven gear 63 for starting. Therefore, the rotational speed of the driving gear shaft 61 by the drive of the starter motor 60 is reduced by the speed reducing gear mechanism 62, the rotational motion is transmitted to the driven gear 63 for starting, the rotational motion of the driven gear 63 for starting is transmitted to the crankcase 10 via the one-way clutch 64, and the internal combustion engine E is started.

As shown in FIG. 4, a drive sprocket 65*a* is rotatably journaled next to the left side of the primary driven gear 53*b* of the main shaft 51, an extended protrusion of the drive sprocket 65*a* is fitted into a hole of the primary driven gear 53*b*, and the drive sprocket is turned integrally with the primary driven gear 53*b*.

Figure 6:
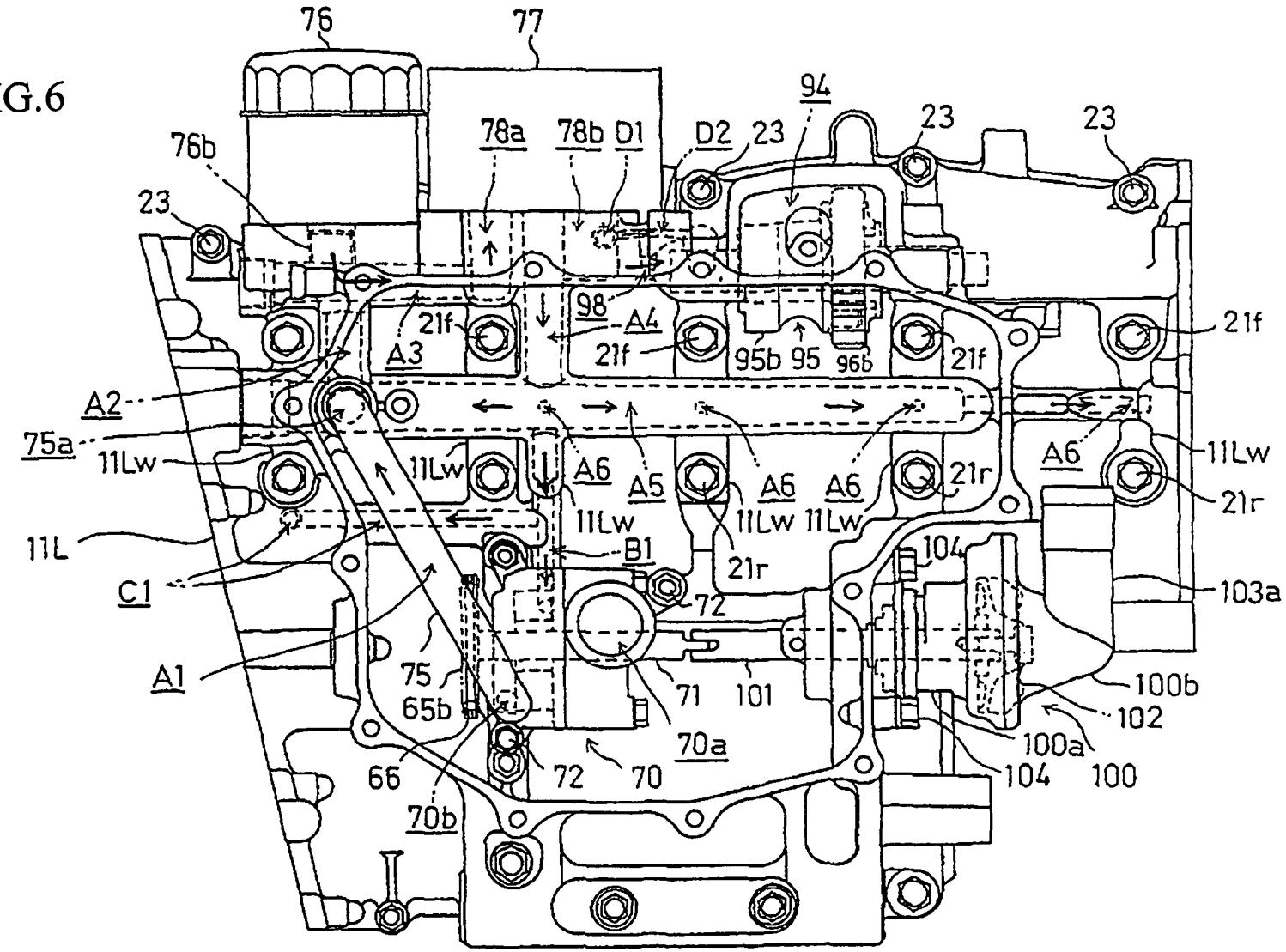
FIG. 6 is a bottom plan view of the crankcase of the internal combustion engine of FIGS. 1-5, with the oil pan removed from the drawing for illustrative purposes.

Referring to FIG. 6, which is a bottom view of the crankcase, it can be seen that an oil pump 70 and a water pump 100 are attached to the lower crankcase 11L so as to be laterally arranged below the main shaft 51.

The oil pump 70, located on the right side (on the left side in FIG. 6), is attached to the inside of the lower crankcase 11L by bolts 72 from below. The water pump 100, located on the left side (on the right side in FIG. 6), is attached to a left side wall of the lower crankcase 11L by bolts 104 by fitting it from the outside. In addition, a drive shaft 71, which protrudes from the left side of the oil pump 70, and a drive shaft 101, which protrudes from the right side of the water pump 100, are coaxially coupled. The drive shaft 71 of the oil pump 70 also protrudes to the right, and a driven sprocket 65*b* is fitted to its right end.

The drive sprocket 65*a*, provided on the main shaft 51, is located above the driven sprocket 65*b*, and an endless chain 66 extends between the drive sprocket 65*a* and the driven sprocket 65*b* (see FIG. 2). Therefore, the rotation of the crankshaft 10 is transmitted from the drive sprocket 65*a*, integrated with the primary driven gear 53*b* of the primary deceleration mechanism, to the driven sprocket 65*b* via the endless chain 66. Thus, the drive shaft 71 of the oil pump 70 and the drive shaft 101 of the water pump 100 are rotated together with the driven sprocket 65*b*.

Referring to FIG. 6, which shows the lower crankcase 11L as viewed from the underside, a balancer chamber 94 is formed between the front of the central journal wall 11Uw corresponding to the cylinder on the center side and the front of the journal wall 11Uw adjacent on the left side (on the right side in FIG. 6) of the above-mentioned journal wall. Both ends of a balancer shaft 95*a* are supported by the right and left journal walls 11Uw, 11Uw in the balancer chamber 94, and a secondary balancer 95 is installed. The secondary balancer 95 is located in downward diagonal front of the crankshaft 10 in the side view shown in FIG. 1.

Figure 7:
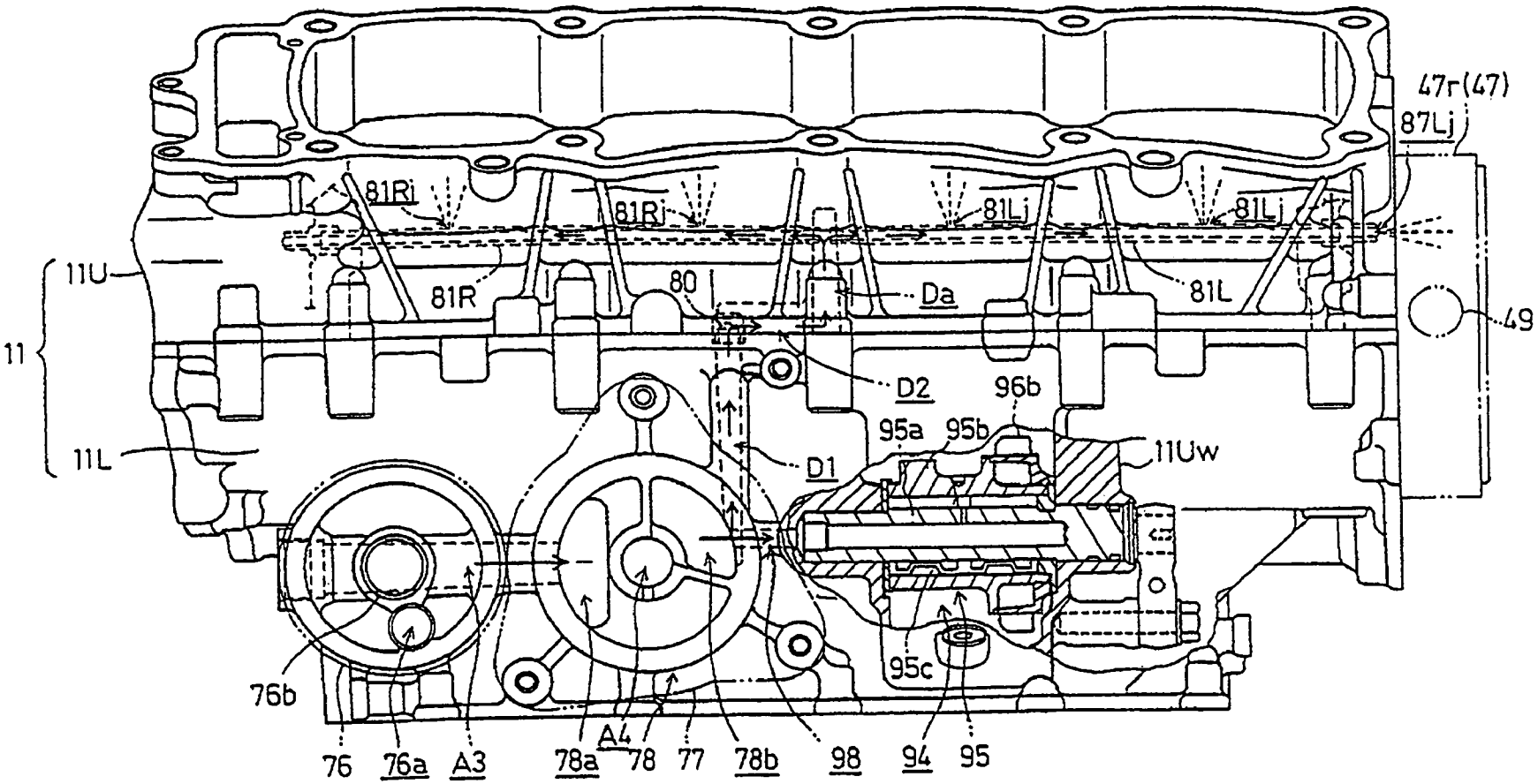
FIG. 7 is a front view of the crankcase of the internal combustion engine of FIG. 1.

Referring to FIG. 7, which is a front view of the crankcase 11, with respect to the secondary balancer 95, balance weight 95*b* is journaled by the balancer shaft 95*a* via a needle bearing 95*c*, and a balancer driven gear 96*b* is mounted on an outer periphery of a boss of the balance weight 95*b*.

The balancer driven gear 96*b* of the secondary balancer 95 is engaged with a balancer drive gear 96*a* (see FIG. 4), which has double the number of teeth of the balancer driven gear 96*b* formed in the crank web of the crankshaft 10. Therefore, the balance weight 95*b* of the secondary balancer 95 is turned at double the rotational speed of the crankshaft 10, and the secondary balancer absorbs secondary vibration of the in-line four-cylinder internal combustion engine 1.

The oil pump 70, which is a hydraulic supply source, is a trochoid pump. In the oil pump 70, an inner rotor integrated with the drive shaft 71 rotates an outer rotor engaged with the inner rotor in the vicinity of the inner rotor, and oil is taken and discharged depending upon the variation of volume between the rotors.

An inlet 70*a* of the oil pump 70 is open downward (see FIG. 6), a suction pipe 73 is coupled to the inlet 70*a* and extends downward into the oil pan 15, and an oil strainer 74 is arranged in a state in which the lower end is brought close to the bottom of the oil pan 15 (see FIG. 2). Therefore, when the oil pump 70 is driven, oil that accumulates in the oil pan 15 is led to the suction pipe 73 via the oil strainer 74 and is pumped up.

A discharge port 70*b* of the oil pump 70 is also open downward, as shown in FIGS. 2 and 6, and one end of an oil supply pipe 75 forming a first oil supply passage A1 is coupled to the discharge port 70*b*. The oil supply pipe 75 extends on the diagonal right side in front (on the left side in FIG. 6), detouring in the oil pan 15 downward. The other end of the oil supply pipe 75 is coupled to an inlet 75*a* open on the downside of the end of a second oil supply passage A2 bored rearward from an inflow port 76*a* (see FIG. 7) of an oil filter 76, the oil filter 76 protruding in the vicinity of the right end of the front of the lower crankcase 11L.

Referring to FIGS. 6 and 7, an oil cooler 77 resides on the left side (on the right side in FIGS. 6, 7) of the oil filter 76, and is arranged in the vicinity of the right end in the front of the lower crankcase 11L, protruding forwardly therefrom. An oil cooler housing 78, including an inflow port 78*a* and an outflow port 78*b* of the oil cooler 77, is formed in a part to which the oil cooler 77 is attached in the front of the lower crankcase 11L. The balancer 95 is arranged adjacent to the left side of the oil cooler housing 78 (see FIG. 6).

As shown in FIG. 6, an outflow cylinder 76*b*, protruding from a rear face of the oil filter 76, communicates with a third oil supply passage A3. The third oil supply passage A3 is a laterally extending bore that communicates with the inflow port 78*a* of the oil cooler housing 78.

A fourth oil supply passage A4 is a bore which extends rearward from the outflow port 78*b* in the center of the oil cooler housing 78 (see FIGS. 6 and 7).

A main gallery A5, which is a fifth oil supply passage, is a bore that extends in parallel with the crankshaft 10 and below the crankshaft 10 so that the main gallery is perpendicular to the fourth oil supply passage A4. The main gallery A5 pierces the five journal walls 11Lw of the lower crankcase 11L, and an oil branch supply passage A6 is provided in each journal wall 11Lw comprising a bore that extends toward each journal bearing.

Referring to FIG. 2, an oil supply passage B1 for supplying oil to the side of the transmission 50 comprises a bore extending diagonally upward toward the rear from the rear end of the oil supply passage A4. In addition, an oil supply passage B2 for supplying oil to a bearing of the main shaft 51 in the upper crankcase 11U comprises a bore which is formed in fluid communication with the oil supply passage B1.

Referring to FIGS. 2 and 6, a first tensioner oil supply passage C1 for supplying oil to the cam chain tensioner 43 flowing rightward from the oil supply passage B1 in the lower crankcase 11L is also bored. The first tensioner oil supply passage C1 branches, reaches the rightmost journal wall 11Lw, is bent upward from its right end, and is open to the joined faces of the upper 11U and lower 11L portions of the crankcase 11.

A recessed portion of suitable volume is formed on the joined face of the right most journal wall 11Uw of the upper crankcase 11U opposite to an opening of the first tensioner oil supply passage C1. The recessed portion functions as an oil reservoir Ca because an opening of the recessed portion is bounded by the joined face of the journal wall 11Lw of the lower crankcase 11L except the opening of the first tensioner oil supply passage C1.

A second tensioner oil supply passage C2 is bored from the oil reservoir Ca diagonally upward and forward toward the cylinder block 12 along the joined face of the journal wall 11Uw in the upper crankcase 11U. The second tensioner oil supply passage C2 is connected to a third tensioner oil supply passage C3 bored in the rear of the right side wall of the cylinder block 12.

The third tensioner oil supply passage C3 in the cylinder block 12 is bent once rearward and is bent again after the third oil supply passage is bored in an axial direction of the cylinder from the face joined to the upper crankcase 11U, and communicates with a fourth tensioner oil supply passage C4 bored in the cylinder head 13 through labyrinth structure Cb formed on the face joined to the cylinder head 13. The fourth tensioner oil supply passage C4 is bent in L-shape, is connected to an inflow port of the cam chain tensioner 43, and supplies oil to the cam chain tensioner 43. The labyrinth structure Cb on the way means a labyrinth on the joined face between the cylinder block 12 and the cylinder head 13 and has effect as a filter.

In the meantime, referring to FIGS. 2 and 7, a first piston oil supply passage D1 for supplying oil for cooling each piston extends upward from the outflow port 78*b* of the oil cooler housing 78. The outflow port 78*b* resides in the lower crankcase 11L, and the first piston oil supply passage D1 is a bored-out passage which extends upward to the face which joins the upper 11U and lower 11L portions of the crankcase 11. A communicating hole 98 is also formed within the outflow port 78*b* of the oil cooler housing 78 that extends toward the balance shaft 95*a* of the balancer 95. The balancer 95 lies adjacent to, and on the left side of the oil cooler 77, and the communicating hole 98 supplies oil for lubricating the balancer 95 (see FIGS. 6 and 7).

The cavity 28, formed in the central journal wall 11Uw out of the five journal walls 11Uw of the upper crankcase 11U, is open to the joined face of the case portions 11U, 11L. A groove for a second piston oil supply passage D2 is formed up to a part where an opening of the cavity 28 in the center of the joined face of the upper crankcase 11U and the first piston oil supply passage D1 are opposite (see FIG. 7). That is, the second piston oil supply passage D2 is formed so that a part of an opening of the groove formed in the upper crankcase 11U is bounded by the joined face of the lower crankcase 11L.

A filter 80 having plural small holes is installed at a connection of the joined face of the case portions 11U, 11L and the second piston oil supply passage D2 at an upper end of the first piston oil supply passage D1. The filter 80 is formed by mechanical working or press working.

The cavity 28, with which the second piston oil supply passage D2 communicates and which is formed in the central journal wall 11Uw of the upper crankcase 11U, is bounded by with the joined face of the lower crankcase 11L to be an oil reservoir Da that has suitable volume and can temporarily reserve oil though the oil reservoir is also a third oil supply passage. As described above, since the oil reservoir Da is formed with the oil reservoir open to the joined face of the upper crankcase 11U, the oil reservoir Da can be simultaneously formed in casting the upper crankcase 11U and no additional mechanical working is required in the formation of the oil reservoir DA. In addition, since the oil reservoir Da is formed because a part of the opening of the oil reservoir Da is closed by the joined face of the lower crankcase 11L, no dedicated cover member is separately required and the number of parts can be reduced.

As described above, referring to FIG. 5, since the tapped hole 26*f* is formed to extend from the face at which the cylinder head 13 is joined to the cylinder block 12, to the oil reservoir Da, the stud bolt 25*f* that extends through the cylinder head 13 and the cylinder block 12 is screwed into the tapped hole 26*f* and a part of the end protrudes into the oil reservoir Da, the concentration in a part of stress that acts on the vicinity of the tapped hole of the upper crankcase 11U by screwing and tightening the stud bolt 25*f* can be reduced. Because this stress concentration reducing structure is formed utilizing the oil reservoir Da for stably supplying oil to oil jets 81Lj, 81Rj, 87Lj described later, no dedicated structure is separately required and working for the structure is also not required.

Figure 8:
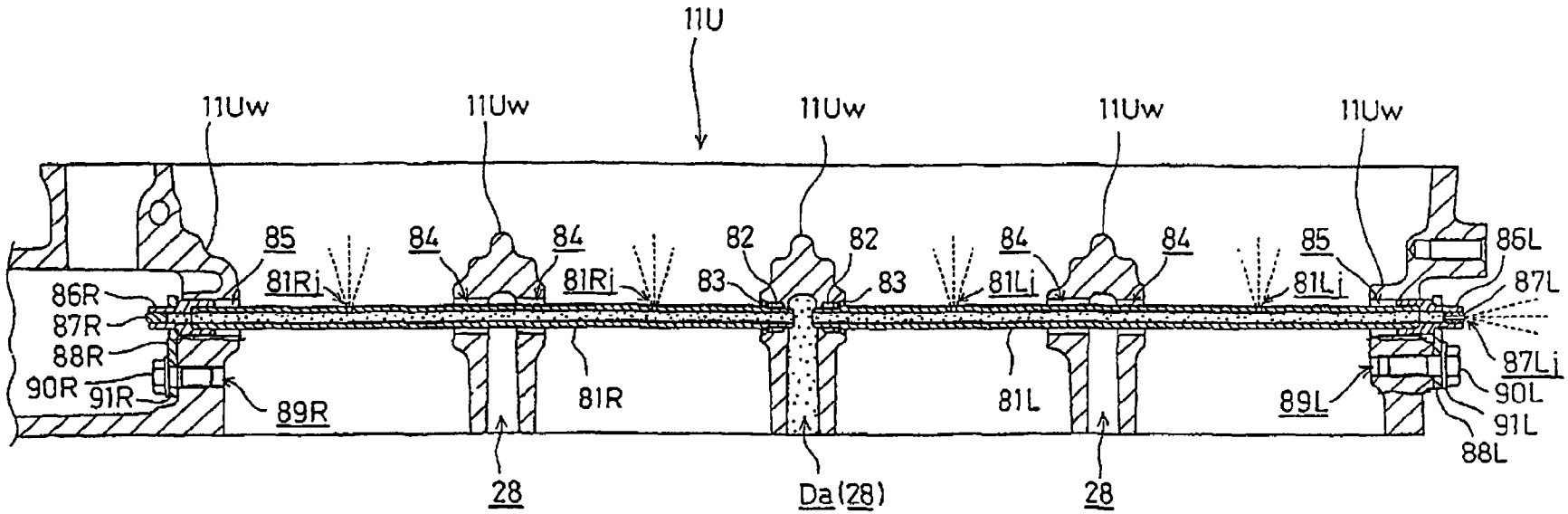
FIG. 8 is a sectional detail view of an upper crankcase portion of the internal combustion engine of FIG. 1.
Figure 9:
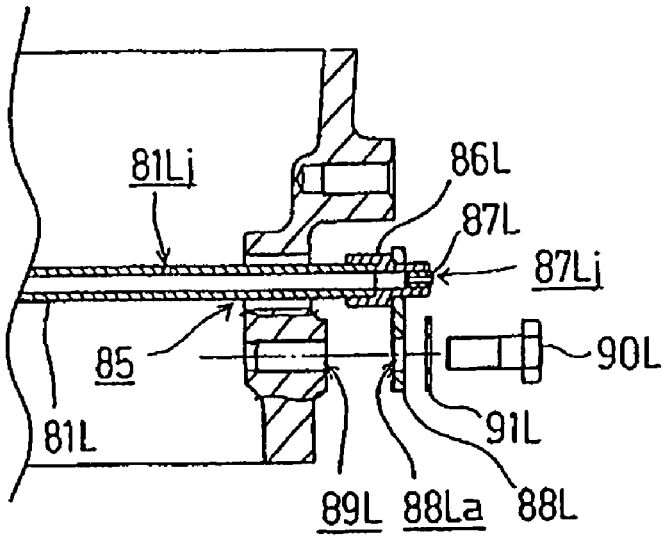
FIG. 9 is an exploded sectional detail view, partially cut away, of the left end portion of the upper crankcase shown in FIG. 8 illustrating the arrangement structure of the oil jet pipe.

Referring to FIG. 8, inner ends of left and right oil jet pipes 81L, 81R for cooling each piston are linear pipe members that are fitted from both left and right sides of the oil reservoir Da. Left and right oil jet pipes extend in space on the upper side of the oil reservoir Da and the pipes extend laterally outside (note that in FIG. 8, the left and the right are reversed).

The piston cooling oil jets 81Lj, 81Rj consist of oil jet holes that are bored on the left and right oil jet pipes 81L, 81R, such that two jet holes are provided on each of the right and left sides of the oil reservoir Da. The piston cooling oil jets 81Lj, 81R direct oil toward an upper side of each cylinder bore 12*c*, and are located at a position intermediate each of the five adjacent journal walls 11Uw.

Circular holes are coaxially formed in a predetermined position on the right and left side walls forming the oil reservoir Da, the inner ends of the left and right oil jet pipes 81L, 81R are fitted into the circular holes via collars 82, 82 and O-rings 83, 83, and an oil inlet which is an opening of the inner end is placed adjacent to the oil reservoir Da for each of the oil jet pipes. The left and right oil jet pipes 81L, 81R pierce circular holes 84, 84 of both left and right journal walls 11Uw, 11Uw adjacent to the central journal wall 11Uw and their outer ends are inserted into circular holes 85, 85 formed in left and right outermost journal walls 11Uw, 11Uw.

The outer ends of the left and right oil jet pipes 81L, 81R are covered with cylindrical nozzle cap members 86L, 86R. The nozzle cap members 86L, 86R are formed to have a reduced diameter at an outer end thereof. That is, the nozzle cap members 86L, 86R are axially non-uniform such that the inside and outside diameter at an inner end is greater than the inside diameters and outside diameters at the outer end thereof. The oil jet pipes 81L, 81R are covered with the nozzle cap members 86L, 86R by press-fitting the oil jet pipes 81L, 81R into the parts having the larger inside diameters, which are equal to outside diameters of the oil jet pipes 81L, 81R.

Portions of the nozzle cap members 86L, 86R having the larger outer diameters are press-fitted into the circular holes 85, 85 formed in the left and right outermost journal walls 11Uw, 11Uw, and the outer ends of the oil jet pipes 81L, 81R are fastened to and supported by the left and right outermost journal walls 11Uw, 11Uw via the nozzle cap members 86L, 86R. As seen in FIG. 8, a portion of the nozzle cap members 86L, 86R corresponding to the part having the larger outside diameters, as well as the and parts having smaller outside diameter protrude outside the left and right outermost journal walls 11Uw, 11Uw.

At one end of the oil jet pipes 81R, 81L, for example the left end, a cylindrical oil jet member 87L is press-fitted, as an oil jet hole, into an outside opening of the smaller inside diameter part of the left nozzle cap member 86L. An nozzle outlet tube 87Lj for cooling the generator is formed at an end of the cylindrical oil jet member 87L. In contrast, on the opposed end of the oil jet pipes, for example the right end, a plug member 87R is press-fitted into an outside opening of the smaller inside diameter part of the right nozzle cap member 86R to close the opening.

Nozzle cap members 86L, 86R are supported on the left and right outermost journal walls 11Uw, 11Uw using stays 88L, 88R. Circular holes at the ends of the plate fitting stays 88L, 88R are press-fitted into the parts having the smaller outside diameters and protruded outside of the nozzle cap members 86L, 86R. Clamping bolts 90L, 90R are screwed and tightened via washers 91L, 91R from the outside after circular holes 88La, 88Ra at bases of the fitting stays 88L, 88R are aligned with tapped holes 89L, 89R formed in each predetermined position of the left and right outermost journal walls 11Uw, 11Uw.

As for a method of mounting the left oil jet pipe 81L, first, the fitting stay 88L is integrally fastened to the outer end of the oil jet pipe 81L via the nozzle cap member 86L beforehand with predetermined relative positional relation maintained.

Figure 10:
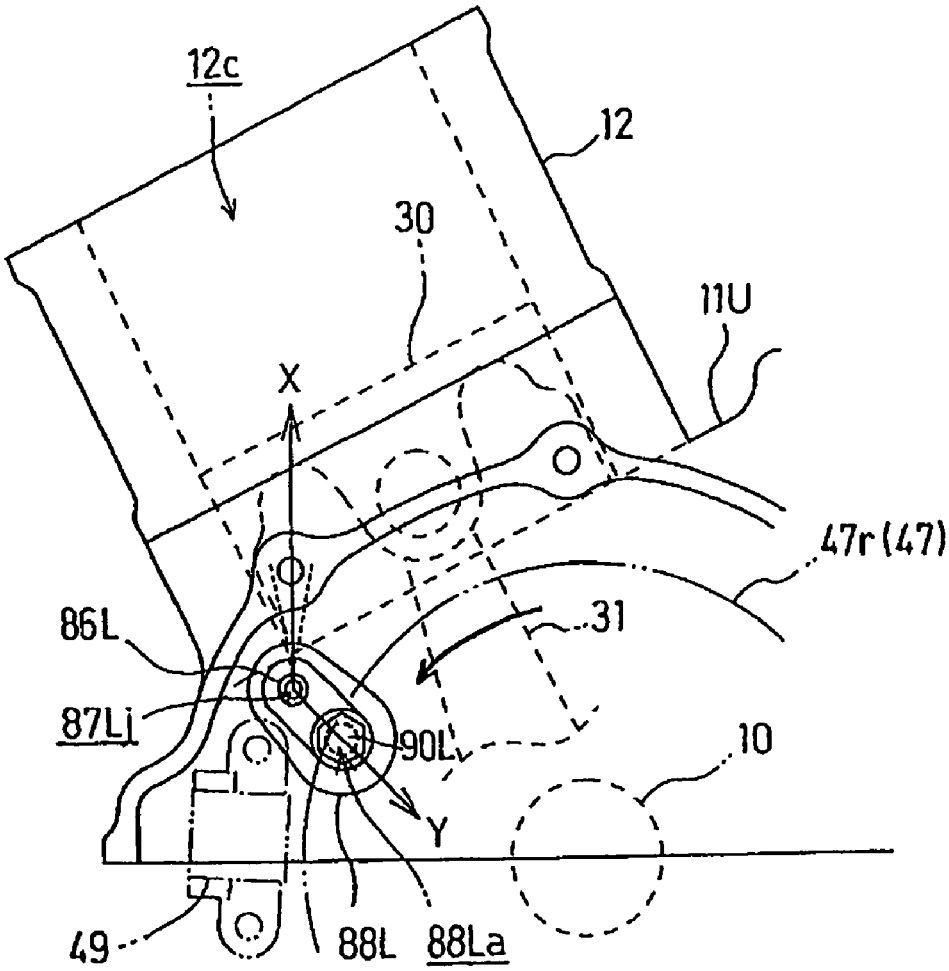
FIG. 10 is a side plan detail view of a portion of the upper crankcase of FIG. 8, in which a part of the upper crankcase is omitted and the oil routing structure of the oil jet pipe is shown.

That is, as shown in FIG. 10, the oil jet pipe 81L and the fitting stay 88L are integrally fastened so that a direction X, in which the oil jet 81Lj for cooling each piston bored on the oil jet pipe 81L exists, and a direction Y, in which the circular hole 88La at the base of the fitting stay 88L exists, form a predetermined relative angle based upon (with respect to) a central axis of the oil jet pipe 81L.

At the same time, when the oil jet pipe 81L, to which the fitting stay 88L is integrally fastened via the nozzle cap member 86L as described above, is inserted into the circular hole 85 of the left outermost journal wall 11Uw from its inner end and extends through the journal wall (see FIG. 9), further extends through the circular hole 84 of the journal wall 11Uw on the way, and is fitted into the circular hole of the central journal wall 11Uw via the collar 82 and the O-ring 83, the nozzle cap member 86L is press-fitted into the circular hole 85.

In press-fitting, when the circular hole 88La at the base of the fitting stay 88L is matched (aligned) with the tapped hole 89L formed in a predetermined position of the left outermost journal wall 11Uw, turning the fitting stay 88L integrally with the oil jet pipe 81L, the oil jet 81Lj for cooling each piston bored on the oil jet pipe 81L can be easily set to a direction which is substantially vertically upward, as shown in FIG. 10, and in which oil is efficiently jetted to each piston 30 reciprocated in the cylinder bore 12*c*.

The oil jet 81Lj for cooling each piston can be fixed in an optimum direction by making the clamping bolt 90L pierce the circular hole 88La at the base via the washer 91L, by screwing and tightening the clamping bolt into the tapped hole 89L after the above-mentioned setting.

Since the other right fitting structure of the oil jet pipe 81R is substantially similar to the oil jet pipe 81L, the oil jet 81Rj for cooling each piston can be fixed in an optimum direction by the similar method. However, the right fitting stay 88R is a little larger than the left fitting stay 88L and has a little longer distance between the circular hole at the end and the circular hole at the base. Therefore, since the tapped hole formed in the predetermined position of the journal wall 11Uw and the circular hole at the base of the fitting stay are not matched (do no align) when the right oil jet pipe and the left oil jet pipe are switched and the clamping bolt cannot be screwed, it is immediately known that the right one and the left one are mistakenly interchanged and wrong mounting can be prevented.

The left and right oil jet pipes 81L, 81R that extend through the five journal walls 11Uw of the upper crankcase 11U and are fitted to the journal walls as described above enable the effectively jetting of oil to the piston 30 in each respective cylinder bore 12*c* by providing oil to each corresponding oil jet 81Lj, 81Rj, whereby each piston 30 is efficiently cooled.

The oil jet member 87L is press-fitted to the left end of the left pipe 81L for jetting oil and oil is jetted leftward from the nozzle outlet tube 87Lj for cooling the generator of the oil jet member 87L.

The nozzle outlet tube 87Lj for cooling the generator does not jet oil directly to the AC generator 47 but rather jets oil toward an annular space formed between the peripheral surface of the outer rotor 47*r* of the AC generator 47 and the inner surface of the generator cover 48 in order to cool the AC generator 47.

As shown in FIG. 10, when the nozzle outlet tube 87Lj for cooling the generator is viewed in an axial direction of the crankshaft, that is, in a left end view thereof, the nozzle outlet tube 87Lj for cooling the generator is positioned inside the generator cover 48 and is located above the pulser coil 49, close to the front of the outer rotor 47*r*. That is, in a left end view of the crankshaft, the nozzle outlet tube 87Lj is positioned above the crankshaft and diagonally forward thereof, and is positioned in front of and in the vicinity of the outer periphery of the outer rotor 47*r* of the AC generator 47.

In the front view shown in FIG. 7, the nozzle outlet tube 87Lj for cooling the generator is located on the right side (on the left side in FIG. 7) of the outer rotor 47*r*, and of the pulser coil 49 which overlaps the outer rotor 47*r* in this view. Therefore, since oil is jetted to space around the outer rotor 47*r* from the nozzle outlet tube 87Lj for cooling the generator, the oil is diffused. However, the space in which the oil is diffused is the annular space between the peripheral surface of the outer rotor 47*r* of the AC generator 47 and the inner surface of the generator cover 48, and is substantially limited to space above the pulser coil 49 and on the diagonal upside in front of the outer rotor 47*r*. The oil diffused space is a part of the space provided for housing the pulser coil 49.

Since the outer rotor 47*r* of the AC generator 47 is turned counterclockwise as shown by an arrow in a left side view shown in FIG. 10, since the pulser coil 49 is located next to the oil jetted area on the downstream side in a rotational direction of the oil jetted area from the nozzle outlet tube 87Lj, and since oil is diffused in substantially limited small space, in contrast to the conventional the diffusion of oil in a large space described above, the oil diffused space is filled with atomized oil.

The outer rotor 47*r* is turned while exposing its peripheral surface to the space which is fitted with oil and in which the oil is diffused. As a result, the oil is uniformly sprayed to the entire peripheral surface of the outer rotor 47*r*, and the outer rotor 47*r* can be uniformly and efficiently cooled.

Oil jetted from the nozzle outlet tube 87Lj for cooling the generator hits the bottom (the inner surface to which the nozzle outlet tube 87Lj for cooling the generator is opposite)

of the bowl-like generator cover 48, and when the oil is passed along the bottom and is supplied to the inner stator 47*s* of the AC generator 47, the inner stator 47*s* is cooled. In this regard, a rib (not shown) is formed which extends from a location in the vicinity opposite to the nozzle outlet tube 87Lj for cooling the generator toward a stator boss at the bottom of the generator cover 48, and oil is guided to the inner stator 47*s* by this rib.

As described above, oil is supplied to both the outer rotor 47*r* and the inner stator 47*s* of the AC generator 47 and the AC generator 47 can be efficiently cooled.

Since the nozzle outlet tube 87Lj for cooling the generator does not jet oil directly to the outer rotor 47*r* but jets oil toward the space in the vicinity thereof, and the oil is diffused in the space, friction to the turning of the outer rotor 47*r* is never increased.

The oil diffused space in which oil is jetted from the nozzle outlet tube 87Lj for cooling the generator and in which oil is diffused utilizes a part of space provided to arrange the pulser coil 49. As a result, the internal combustion engine is prevented from being enlarged by separately providing spaces.

As described above, the oil jet pipe 81L provided for cooling each piston is also utilized as a means for supplying oil to the nozzle outlet tube 87Lj for cooling the AC generator 47. As a result, a dedicated oil passage for cooling the AC generator 47 is not required to be newly formed, the engine structure is simplified, processing man-hours and the number of parts thereof are reduced, and the cost is reduced.

Since the paths of oil supply are configured as described above, oil discharged from the discharge port 70*b* when the oil pump 70 is driven flows into the oil filter 76 from the second oil supply passage A2 through the first oil supply passage A1 (the oil supply pipe 75), impurities such as dust are removed there, the oil flows into the third oil supply passage A3, flows into the oil cooler 77 through the inflow port 78*a* and is cooled there, the oil flows from the outflow port 78*b* into the fourth oil supply passage A4, reaches the main gallery A5, flows from the main gallery A5 to the crankshaft 10 and into the oil supply passages B1, B2 through the oil branch supply passage A5, and the oil is supplied to hydraulic equipment such as the cam chain tensioner 43 through each part to be lubricated such as the transmission 50 and the oil supply passages C1, C2, C3, C4.

In the meantime, oil divided from the outflow port 78*b* of the oil cooler 77 into a first oil supply passage D1 reaches the oil reservoir Da from a second oil supply passage D2 via a filter 80 on the joined faces of the upper crankcase 11U and the lower crankcase 11L, is distributed from the oil reservoir Da to the left and right pipes 81L, 81R for jetting oil, is jetted from the oil jets 81Lj, 81Rj for cooling each piston and the nozzle outlet tube 87Lj for cooling the generator of the pipes 81L, 81R for jetting oil, each piston 30 is cooled by the oil jetted from the oil jets 81Lj, 81Rj for cooling each piston, and the AC generator 47 is cooled by the oil jetted from the nozzle outlet tube 87Lj for cooling the generator.

Since the oil reservoir Da is provided on the upstream side on which oil is distributed to the left and right oil jet pipes 81L, 81R, the pulsation of the oil discharge pressure of the oil pump 70 is attenuated, oil is distributed to the oil jet pipes 81L, 81R, is stably supplied to the oil jets 81Lj, 81Rj for cooling each piston and the nozzle outlet tube 87Lj for cooling the generator, is stably jetted from the oil jets 81Lj, 81Rj for cooling each piston and the nozzle outlet tube 87Lj for cooling the generator, and each piston 30 and the AC generator 47 are more efficiently cooled.

In addition, as described above, the tapped hole 26*f* is formed to extend from the joined face of the cylinder block 12 to the cylinder head 13 to the oil reservoir Da, the stud bolt 25*f* that extends through the cylinder head 13 and the cylinder block 12 is screwed into the tapped hole 26*f*, and the end protrudes into the oil reservoir Da. As a result, the concentration in a part of stress that acts on the vicinity of the tapped hole of the upper crankcase 11U by screwing and tightening the stud bolt 25*f* is reduced. Because the stress concentration reducing structure is configured utilizing the oil reservoir Da for stably supplying oil to the oil jets 81Lj, 81Rj, 87Lj, a separate, dedicated structure is not required, and the corresponding work for achieving the dedicated structure is not required.

Since the oil reservoir Da utilizes the cavity 28 of the central journal wall 11Uw, oil is uniformly distributed to the left and right oil jet pipes 81L, 81R, is uniformly supplied to the four oil jets 81Lj, 81Rj for cooling each piston 30, and is efficiently jetted from them. Since the oil jets 81Lj, 81Rj for cooling each piston are formed on the left and right oil jet pipes 81L, 81R, plural oil jets 81Lj, 81Rj for cooling each piston can be concentrated on the oil jet pipes 81L, 81R as a tube-like member, compared with a case that an oil jet is attached to each journal wall of the crankcase. Therefore, the internal combustion engine employing the oil jet pipes 81L, 81R is excellent in terms of ease of assembly.

In this embodiment, the two oil jet pipes 81L, 81R extend sideways, one pipe extending from each side of the oil reservoir Da. However, an alternative embodiment may be provided in which only a single oil jet pipe is used which extends through the oil reservoir Da and to both sides of the oil reservoir Da, the single oil jet pipe including an inlet open to the oil reservoir.

In this water-cooled internal combustion engine E, a cooling system is provided in which the drive shaft 71 and the drive shaft 101 are coupled and cooling water is supplied by the water pump 100 driven in interlock with the oil pump 70, and is configured as a supply source for cooling water.

In the cooling system of this internal combustion engine E, referring to FIG. 1, the water pump 100 is attached to the rear of the left side wall of the lower crankcase 11L as described above, a radiator 105 is arranged in front of the internal combustion engine E, and a thermostat 110 is coupled to an outflow pipe 108 which extends rearward from the underside of the intake port 33 of the cylinder at the right end of the cylinder head 13.

The other end of a radiator inflow hose 106, one end of which is connected to a connecting pipe 110*a* protruded on the right side of the thermostat 110, is connected to an inflow port of the radiator 105 detouring forward on the right side of the cylinder block 12 as shown in FIGS. 2 and 3. The connecting pipe 110*a* protrudes in space between the cam chain tensioner 43 and the overhanging part 11Ua of the upper crankcase 11U as shown in FIG. 2, the radiator inflow hose 106 passes the space, and extends rightward.

The water pump 100 is configured by a pump body 100*a* in which a pump house for housing an impeller 102. The impeller 102 turns integrally with the drive shaft 101, and the drive shaft 101 is journaled on the pump house. One end of a radiator outflow hose 107 is connected to a connecting pipe 103*a* which extends in front of a suction port of the pump cover 10*b*. A pump cover 100*b* (see FIG. 6) and the other end of the radiator outflow hose 107 is connected to an outflow port of the radiator 105 arranged along a lower part of the left side of the lower crankcase 11L.

One end of a bypass hose 112 is connected to the connecting pipe 103*b* which extends on the upside of the same suction port of the pump cover 100*b*. The bypass hose 112 extends upward along each rear of the left sides of the lower crankcase 11L and the upper crankcase 11U as shown in FIGS. 1 and 3, is bent on the diagonal right side forward on a top face of the upper crankcase 11U, passes the left side of the starter motor 60, extends rightward and diagonally upward between the starter motor 60 and the cylinder block 12 or the cylinder head 13 as shown in the plan in FIG. 3, and the other end is connected to a bypass outflow port on the upside of the thermostat 110.

Further, one end of a pump discharge hose 113 is connected to a connecting pipe 103*c* extending from a discharge port of the pump cover 100*b* of the water pump 100. The pump discharge hose 113 extends upward along each rear of the left sides of the lower crankcase 11L and the upper crankcase 11U, is bent forward, and the other end is connected to an inflow connecting pipe 115*b* extended at the diagonal back of a joint member 115 which protrudes from the left side of the cylinder block 12.

The joint member 115 has an internal space 115*a* open to a joined face to the cylinder block 12 and longer in height, and a flange part at the edge of an opening is fastened to the cylinder block 12 by bolts 116 in three locations (see FIGS. 1 and 4).

As shown in FIG. 4, a lower inflow port 120 and an upper inflow port 121 respectively vertically partitioned are formed opposite to the opening of the internal space 115*a* of the joint member 115 on the left sidewall of the cylinder block 12. The lower inflow port 120 communicates with a first water jacket 12*w* formed around the cylinder bore 12*c* of the cylinder block 12, a communicating hole 122 bent upward ranges to a communicating hole 123 of the cylinder head 13 from the upper inflow port 121, and the communicating hole 123 communicates with a second water jacket 13*w* of the cylinder head 13.

As shown in FIG. 1, a branch connecting pipe 115*c* extends diagonally forward from the joint member 115, and an inflow hose 117 for the oil cooler, one end of which is connected to the branch connecting pipe 115*c*, extends diagonally forward and downward. The other end of the inflow hose 117 is connected to a water inflow port of the oil cooler 77 which protrudes from the front of the lower crankcase 11U. An outflow hose 118 extends from a water outflow port of the oil cooler 77, and is coupled to the radiator outflow hole 107. The outflow hose 118 returns cooling water via the oil cooler 77 to the water pump 100 utilizing a part of the radiator outflow hose 107.

In the cooling system of the internal combustion engine E configured as described above, cooling water discharged by the drive of the water pump 100 reaches the joint member 115 of the cylinder block 12 through the pump discharge hose 113, the lower inflow port 120 and the upper inflow port 121 respectively on the left side wall of the cylinder block 12 branch from the joint member 115 of the cylinder block 12, cooling water that flows into the lower inflow port 120 flows rightward in the first water jacket 12*w* of the cylinder block 12 and cools the cylinder block 12, cooling water that flows into the upper inflow port 121 flows rightward in the second water jacket 13*w* of the cylinder head 13 through the communicating holes 122, 123 and cools the cylinder head 13.

A gasket (not shown) held between the joined faces of the cylinder block 12 and the cylinder head 13 partitions the first water jacket 12*w* of the cylinder block 12 and the second water jacket 13*w* of the cylinder head 13. However, a communicating hole is bored in a part of the right end, cooling water that cools the cylinder block 12 flows from the first water jacket 12*w* into the second water jacket 13*w*, cooling water that flows independently in the first water jacket 12*w* and in the second water jacket 13*w* meet, the cooling water flows out of the outflow pipe 108 which extends rearward at the right end of the rear of the cylinder head 13, and reaches the thermostat 110.

The thermostat 110 controls the circulation and the cutoff of cooling water to the radiator 105 according to the warming up of the internal combustion engine E.

During engine warm up, the warming up process is accelerated by making cooling water that passes the cylinder block 12 and the cylinder head 13 flow into the bypass hose 112 without passing through the radiator 105, and returning it to the water pump 100. In normal operation after the engine is warmed up, the cooling water is made to flow into the radiator 105 by switching to the flow into the radiator inflow hose 106, the temperature of the cooling water is lowered by circulating the cooling water in the radiator, and the cooling of the cylinder block 12 and the cylinder head 13 is accelerated.

In the meantime, cooling water discharged into the pump discharge hose 113 from the water pump 100 is divided into the lower inflow port 120 and the upper inflow port 121 of the cylinder block 12 via the joint member 115, and the cooling water is circulated so as to cool oil so that the cooling water is also divided into the inflow hose 117 in the internal space 115*a* of the joint member 115, reaches the oil cooler 77 and returns to the water pump 100 via a part of the radiator outflow hose 107 through the outflow hose 118 from the oil cooler 77.

As described above, oil cooled by the oil cooler 77 is divided from the outflow port 78*b* of the oil cooler housing 78 into the first oil supply passage D1, is distributed to the left and right pipes 81L, 81R for jetting oil through the second oil supply passage D2 and the oil reservoir Da, is jetted to each piston 30 from the oil jets 81Lj, 81Rj for cooling each piston to cool each piston 30, and is jetted from the nozzle outlet tube 87Lj for cooling the generator to cool the AC generator 47.

Since oil for cooling is divided at the outflow port 78*b* on the immediate downstream side of the oil cooler 77 and is supplied to parts to be cooled of each piston 30 and the AC generator 47, the parts to be cooled can be cooled by oil kept at low temperature.

While a working example of the present invention has been described above, the present invention is not limited to the working example described above, but various design alterations may be carried out without departing from the present invention as set forth in the claims.

What is claimed is:

1. A piston cooling system in an internal combustion engine, the engine comprising:

a crankshaft;

a crankcase comprising at least one journal wall that journals the crankshaft;

a cylinder block comprising at least one cylinder bore; and a piston reciprocally disposed in the at least one cylinder bore, the piston cooling system comprising:

an oil jet disposed in a wall portion of said crankcase;

an oil supply passage formed in the crankcase in fluid communication with said oil jet, for routing oil from a hydraulic supply source oil to the oil jet; and an oil reservoir formed in the at least one journal wall, the oil reservoir communicating with the oil supply passage, wherein said piston cooling system is configured to jet oil from the oil supply passage to the piston via the oil jet during operation of said engine.

2. The piston cooling system in an internal combustion engine according to claim 1, wherein:

the crankcase is partitioned into an upper crankcase portion and a lower crankcase portion, the upper and lower crankcase portions being joined at respective joined faces thereof;

the oil reservoir is formed in a first one of said crankcase portions so that the oil reservoir is open to the joined face of the first crankcase portion; and the oil reservoir is further defined by closing a part of an opening for the oil reservoir with the joined face of the other of said crankcase portions.

3. The piston cooling system in an internal combustion engine according to claim 1, wherein:

the internal combustion engine comprises a plurality of cylinders arranged in parallel;

the oil jet is formed on a tube-like member arranged on an axis parallel to the crankshaft; and an oil inlet of the tube-like member is open to the oil reservoir.

4. The piston cooling system in an internal combustion engine according to claim 1, wherein:

the cylinder block is joined to the crankcase along a pair of respective joined faces thereof, a tapped hole extends from the respective joined faces through the cylinder block to the oil reservoir, the engine further comprising a fastening member having a threaded end portion which is threadably engaged in the tapped hole;

wherein a tip part of the end portion of said fastening member protrudes into the oil reservoir.

5. The piston cooling system in an internal combustion engine according to claim 1, wherein the cooling system further comprises an oil cooler disposed at a lower portion of the crankcase, wherein the crankcase is partitioned into an upper crankcase portion and a lower crankcase portion, the upper and lower crankcase portions joined at respective joined faces thereof, wherein the oil supply passage comprises a first passage portion and a second passage portion, the first passage portion comprising a bore extending upwardly from the oil cooler to the respective joined faces, the second passage portion comprising a groove formed in the upper crankcase portion which is bounded by the joined face of the lower crankcase portion, the groove providing communication between the first passage portion and the oil reservoir.

6. The piston cooling system in an internal combustion engine according to claim 5, wherein the oil reservoir is formed in the upper crankcase portion in a manner such that the oil reservoir is open to the joined face of the lower crankcase portion.

7. The piston cooling system in an internal combustion engine according to claim 5, wherein a filter is installed at an intersection of the respective joined faces and the first passage portion.

8. The piston cooling system in an internal combustion engine according to claim 5, wherein the oil reservoir provides dual functions, comprising:

providing a location in which oil can be temporarily reserved; and providing an oil passageway between the second passage portion and the oil jet.

9. An internal combustion engine provided with an internal piston cooling system, the engine comprising:

a crankshaft;

a crankcase comprising plural journal walls that journal the crankshaft therebetween;

a cylinder block comprising plural parallel cylinder bores; and a piston reciprocally disposed in each cylinder bore, respectively, the piston cooling system comprising:

an oil jet provided for dispensing oil to each respective cylinder bore;

an oil supply passage formed in the crankcase for supplying oil from a hydraulic supply source oil to each oil jet; and an oil reservoir formed in the at least one journal wall that communicates with the oil supply passage, wherein said piston cooling system is configured to jet oil from the oil supply passage to each of said pistons, via the respective oil jets, during operation of said engine.

10. The internal combustion engine according to claim 9, wherein:

the crankcase is partitioned into an upper crankcase portion and a lower crankcase portion, the upper and lower crankcase portions joined at respective joined faces thereof;

the oil reservoir is formed in one of said crankcase portions so that the oil reservoir is open to the joined face of the one of said crankcase portions; and the oil reservoir is further formed by closing a part of an opening for the oil reservoir with the joined face of the other one of said crankcase portions.

11. The internal combustion engine according to claim 9, wherein:

the oil jets are formed at intervals on a tube-like member arranged on an axis parallel to the crankshaft; and an oil inlet of the tube-like member is open to the oil reservoir.

12. The internal combustion engine according to claim 9, wherein:

the cylinder block is joined to the crankcase along a second pair of respective joined faces, a tapped hole extends from the second pair of respective joined faces through the cylinder block to the oil reservoir, and a part of the end of a fastening member screwed into the tapped hole protrudes into the oil reservoir.

13. The internal combustion engine according to claim 9, wherein:

the cylinder block comprises four cylinder bores, the crankcase comprises a central journal, a first outer journal disposed at a first end of the crankshaft, a second outer journal disposed at an opposed end of the crankshaft, a first intermediate journal disposed between the central journal and the first outer journal, and a second intermediate journal disposed between the central journal and the second outer journal, and the oil reservoir is formed in cavity formed in the central journal.

14. The internal combustion engine according to claim 13, wherein:

an oil jet is provided between each of the first outer journal and the first intermediate journal, the first intermediate journal and the central journal, the central journal and the second intermediate journal, and the second intermediate journal and the second outer journal.

* * * * *